US005221495A

United States Patent [19]

Cao

[11] Patent Number: 5,221,495

[45] Date of Patent: Jun. 22, 1993

[54] ENZYME STABILIZING COMPOSITION AND STABILIZED ENZYME CONTAINING BUILT DETERGENT COMPOSITIONS

[75] Inventor: Hoai-Chau Cao, Liege, Belgium

[73] Assignee: Colgate-Palmolive Company, New York, N.Y.

[21] Appl. No.: 684,149

[22] Filed: Apr. 12, 1991

Related U.S. Application Data

[63] Continuation of Ser. No. 509,549, Apr. 13, 1990, abandoned.

[51] Int. Cl.[5] ..... C11D 3/386; C11D 3/06; C11D 3/12

[52] U.S. Cl. ..... 252/135; 252/174.12; 252/174.19; 252/DIG. 12; 252/DIG. 14; 435/188

[58] Field of Search ..... 252/135, 174.12, 174.19, 252/DIG. 12, DIG. 14; 435/188

[56] References Cited

U.S. PATENT DOCUMENTS

| | | | |
|---|---|---|---|
| 4,111,855 | 9/1978 | Barrat et al. | 252/545 |
| 4,287,082 | 9/1981 | Tolfo et al. | 252/174.12 |
| 4,305,837 | 12/1981 | Kaminsky et al. | 252/174.12 |
| 4,318,818 | 3/1982 | Leeton et al. | 252/174.12 |
| 4,507,219 | 3/1985 | Hughes | 252/118 |
| 4,529,525 | 7/1985 | Dormol et al. | 252/132 |
| 4,532,064 | 7/1985 | Boskamp | 252/105 |
| 4,537,706 | 8/1985 | Severson, Jr. | 252/545 |
| 4,537,707 | 8/1985 | Severson, Jr. | 252/545 |
| 4,842,769 | 6/1989 | Shulman et al. | 252/8.6 |
| 4,900,475 | 2/1990 | Ramachondran et al. | 252/532 |
| 5,019,292 | 5/1991 | Baeck et al. | 252/135 |
| 5,030,378 | 9/1991 | Veneges | 252/174.12 |

*Primary Examiner*—Paul Lieberman
*Assistant Examiner*—Kery A. Fries
*Attorney, Agent, or Firm*—Bernard Lieberman; Robert C. Sullivan

[57] ABSTRACT

A three component enzyme stabilization system including boric acid, citric acid and calcium ions helps maintain the enzyme activity of aqueous built detergent compositions in accelerated aging (multiple freeze-thaw cycles). The preferred detergent compositions are "softergents" and also include a clay softener, a mixture of anionic, nonionic and amphoteric surfactants, and detergent builder(s).

21 Claims, No Drawings

ENZYME STABILIZING COMPOSITION AND STABILIZED ENZYME CONTAINING BUILT DETERGENT COMPOSITIONS

This application is a continuation of application Ser. No. 07/509,549, filed Apr. 13, 1990 now abandoned.

BACKGROUND OF THE INVENTION

This invention relates to stable, built, enzyme-containing liquid detergent compositions suitable for laundry or pre-soak formulations. More particularly, the invention relates to aqueous enzyme-containing liquid detergent compositions which contain one or more detergent builders and which are characterized by being physically stable, homogeneous liquid compositions, having improved enzyme stability. The invention also relates to the novel stabilized enzyme preparation useful as a laundry additive, as well as to the novel enzyme stabilization system, per se.

The formulation of stabilized enzyme-containing liquid detergent compositions has been the focus of much attention in the prior art. The desirability of incorporating enzymes into detergent compositions is primarily due to the effectiveness of proteolytic and amylolytic enzymes in decomposing proteinaceous and starch materials found on soiled fabrics, thereby facilitating the removal of stains, such as, gravy stains, blood stains, chocolate stains and the like during laundering. However, enzymatic materials suitable for laundry compositions, particularly proteolytic enzymes, are relatively expensive. Indeed, they generally are among the most expensive ingredients in a typical commercial liquid detergent composition, even though they are present in relatively minor amounts. Moreover, enzymes are known to be unstable in aqueous compositions. It is for this reason that an excess of enzymes is generally required in liquid detergent formulations to compensate for the expected loss of enzyme activity during prolonged periods of storage. Accordingly, the prior art is replete with suggestions for stabilizing enzyme-containing liquid detergent compositions, and in particular by the use of various materials which are incorporated into the composition to function as enzyme stabilizers.

In the case of liquid detergent compositions containing a builder, the problem of enzyme instability is particularly acute. Primarily this is because detergent builders have a destabilizing effect on enzymes, even in compositions containing enzyme stabilizers which are otherwise effective in unbuilt formulations. Moreover, the incorporation of a builder into a liquid detergent composition poses an additional problem, namely, the ability to form a stable single-phase composition; the solubility of sodium tripolyphosphate, for example, being relatively limited in aqueous compositions, and especially in the presence of anionic and nonionic detergents.

Attempts to stabilize enzyme activity in aqueous media are extensively described in the patent literature. Among the approaches to the problem of enzyme stabilization has been the use of various organic materials, such as alcohols, polyols, acids, esters and sugars which are said to have a stabilizing effect upon enzymes. Water-soluble calcium salts and boron compounds have also been used to stabilize enzyme compositions. Thus, for example, U.S. Pat. No. 4,253,543 to Guilbert seeks to provide enzyme stability by adding an anti-oxidant and a polyol to aqueous detergent compositions. U.S. Pat. No. 4,111,855 ,to Barrat, et al. uses a combination of from about 0.05 to about 1.5% by weight of a polyacid capable of forming water-soluble Cacomplexes, such as citric acid, and calcium ion in an amount of from 0.5 to 15 millimoles per liter as an enzyme stabilizer.

U.S. Pat. No. 4,287,082 to Tolfo, et al. discloses homogeneous enzyme-containing liquid detergents characterized by the presence of a $C_{10}$–$C_{16}$ saturated fatty acid, calcium ion and a $C_1$–$C_3$ short chain monocarboxylic acid or salt thereof.

U.S. Pat. No. 4,318,818 to Letton, et al. also describes an enzyme composition which is stabilized by calcium ion and a short chain length carboxylic acid salt. A polyacid may also be present in the compositions of Letton, et al. as well as those of Tolfo, et al.

In U.K. Patent Application G.B. 2,079,305, published Jan. 20, 1982 and Canadian Patent 1,092,036, there is disclosed an aqueous built enzyme-containing liquid detergent composition which is stabilized by a mixture of a polyol and boric acid.

In U.S. Pat. No. 4,532,064, there is disclosed an aqueous enzyme-containing liquid detergent composition containing an enzyme stabilizing mixture consisting of certain dicarboxylic acids and borax. The dicarboxylic acids of the formula $COOH—(CHOH)_a—(CH_2)_b—(CHOH)_c—(CH_2)_d—COOH$ in which a, b, c, d are whole numbers from 0 to 4, the sum $a+b+c+d=0$ to 4, or the alkali metal, ammonium, alkanolamine or alkaline earth metal salts thereof, are recommended as a substitute for a polyol such as glycerol in known enzyme stabilizing mixtures consisting of glycerol and a boron compound. However, such dicarboxylic acid-borax mixtures in common with the aforementioned mixtures of glycerine and borax provide only a modest stabilizing effect in unbuilt liquid detergent compositions, especially under freezethaw conditions.

U.S. Pat. No. 4,529,525 to Dormal, et al. discloses an unbuilt stabilized enzyme-containing liquid detergent composition comprising: (a) from about 5 to about 75%, by weight, of one or more non-soap detergent surface active agents selected from the group consisting of anionic, nonionic, cationic, ampholytic and zwitterionic detergent compounds; (b) from about 0.1 to about 20 millimoles of calcium ion per liter of composition; (c) from about 0.05 to about 5%, by weight, of an enzyme selected from the group consisting of proteases, amylases and mixtures thereof; (d) from about 0.1 to about 10%, by weight, of a stabilizing agent comprising (i) at least one water-soluble salt of a dicarboxylic acid represented by the formula $(CH_2)n(COOH)_2$ wherein n is an integer from 1 to 6; and/or (ii) at least one water-soluble salt of an unsaturated dicarboxylic acid selected from the group consisting of fumaric acid and maleic acid; (e) from about 0 to about 25%, by weight, of a soap comprising a water-soluble salt of a saturated fatty acid having 10 to 18 carbon atoms in the alkyl chain; and (f) the balance water and optionally a sequestrant. This patent also illustrates two formulations containing sodium borate in place of a dicarboxylic acid of the above formula. Sodium tartrate is also exemplified in specific formulations.

U.S. Pat. No. 4,842,769 to Shulman, et al. discloses a stabilized fabric softening built, enzyme-containing liquid detergent composition comprising:

(a) from about 5 to 20%, by weight, of one or more surface active detergent compounds selected from the group consisting of anionic, nonionic and amphoteric detergent compounds;

(b) from about 5 to 30%, by weight, or one or more builder salts selected from the group consisting of alkali metal tripolyphosphates, alkali metal carbonates, alkali metal nitrilotriacetates, and polyacetal carboxylates;

(c) from about 5 to 20%, by weight, of a swelling bentonite clay;

(d) an effective amount of an enzyme or an enzyme mixture selected from the group consisting of alkaline protease enzymes and alpha-amylase enzymes;

(e) an enzyme-stabilizing system containing, based on the weight of the detergent composition, (i) from about 1 to 10% glycerine; (ii) from about 1 to 8% of a boron compound selected from the group consisting of boric acid, boric oxide, and alkali metal borates and, (iii) from about 0.5 to 8% of a carboxylic acid compound selected from the group consisting of mono, di and/or polycarboxylic acids having 1 to 8 carbon atoms, and which may contain hydroxy or amino substituents, and water-soluble salts thereof; and (f) the balance comprising water and optionally perfume and other adjuvants.

The related U.S. Pat. Nos. 4,537,706 and 4,537,707 to Severson, Jr. each disclose heavy-duty liquid detergent compositions comprising, by weight:

(a) from about 10% to about 50% of an anionic synthetic surfactant;

(b) from about 3% to about 30% of a $C_{10}$–$C_{22}$ fatty acid;

(c) from about 2% to about 15% of a water-soluble detergency builder;

(d) from about 0.01% to about 5% of a proteolytic or amylolytic enzyme;

(e) from about 0.25% to about 10% of boric acid or a boron compound capable of forming boric acid in the composition;

(f) from about 1 to about 30 millimoles of calcium ion per liter of composition; and (g) from about 20% to about 80% of water; and in the '707 patented composition (h) from about 0.05% to about 5% of a water-soluble formate. The compositions may also include various optional ingredients, including the known polyol enzyme stabilizers. The polycarboxylates are disclosed as preferred builders and citrates as highly preferred builder materials. The formulations of Example I of these patents include a polyacid, i.e. citric acid (anhydrous) in an amount of 4.0 weight%. The exemplified levels of boric acid range from 0.5 to 2.0% and the exemplified calcium ion concentrations range from 9.65 to 15.6 millimoles per liter.

In our commonly assigned copending application Ser. No. 07/255,817 filed Oct. 7, 1988, titled HEAVY DUTY FABRIC SOFTENING LAUNDRY DETERGENT COMPOSITION, the disclosure of which is incorporated herein in its entirety by reference, a highly advantageous "softergent" liquid composition based on a combination of anionic and nonionic surfactants and a certain type of amphoteric surfactant, inorganic builder, bentonite and water is disclosed. These compositions may, and preferably do, also include enzyme(s) and enzyme stabilization system. The enzyme stabilizer system includes 0.5 to 5% of a mixture of dibasic acid of 4 to 6 carbon atoms each, 1 to 3% of boric acid and 0.1 to 0.5% of a source of calcium ion. However, as will be shown in the examples which follow, the stabilizing power of this stabilization system is less efficient than the stabilization system according to this invention.

While many of these previously described formulations have been able to extend the useful life of the enzyme component(s) under normal or slightly elevated temperatures, e.g. 90° F., 100° F. or 110° F (in Canadian Patent 1,092,036 enzyme stabilization was measured at about 133° F. to 140° F.), still further improvements are desired, especially with regard to the enzyme stabilization for enzyme containing compositions subjected to more severe storage conditions, such as freeze-thaw conditions.

SUMMARY OF THE INVENTION

The present invention provides a built liquid detergent composition which contains, on a weight basis, (A) from about 5 to about 75% of one or more surface active detergent compounds, (B) from about 5 to about 30%, of one or more detergency builders;

(C) from about 0.01 to about 5% of at least one enzyme selected from the group consisting of proteases, amylases and mixtures thereof;

(D) an enzyme stabilization system which includes, (i) from about 0.25 to about 10% of a boron compound selected from the group consisting of boric acid, boron oxide and alkali metal borates;

(ii) from about 1 to about 3% of an hydroxycarboxylic acid selected from the group consisting of aliphatic di- and tri-carboxylic acids with from 1 to 4 hydroxyl groups and from 4 to 8 carbon atoms; and (iii) a water soluble calcium salt in an amount sufficient to provide from about 18 to about 50 millimoles of calcium ion per liter of the composition; and (E) water.

In a preferred embodiment of the invention, the built enzyme-containing liquid composition includes (A) from about 5 to about 30%, by weight, of a mixture of (a) non-soap anionic surface active detergent compound and (b) nonionic surface active detergent compound at an (a):(b) ratio, by weight, of from about 1:4 to about 10:1;

(B) from about 5 to about 25%, by weight, of at least one detergency builder selected from the group consisting of alkali metal polyphosphates, alkali metal carbonates, alkali metal nitrilotriacetates, polyacetal carboxylates, and mixtures thereof;

(C) from about 0.1 to about 3%, by weight, of a protease, amylase, or mixed protease-amylase enzyme system;

(D) an enzyme stabilization system containing (i) from about 0.5 to about 8%, by weight, of boric acid, boric oxide or alkali metal borate;

(ii) from about 1.5 to about 2.5%, by weight, of citric acid; and (iii) a water-soluble calcium salt in an amount sufficient to provide from about 22 to about 36 millimoles of calcium ion per liter of the composition;

(E) from about 5 to about 20%, by weight, of a clay softening agent; and (F) water, and optionally perfume and other adjuvants.

In accordance with the process of the invention, laundering of stained and/or soiled materials is affected by contacting such materials with an aqueous solution of the above-defined liquid detergent compositions.

The described liquid detergent is a commercially acceptable heavy duty laundry detergent, capable of satisfactorily cleaning laundry items containing both oily and particulate soils. Additionally, the described compositions may be employed for the pre-treatment of badly soiled areas, such as collars and cuffs, of items to be laundered.

While the three components of the enzyme stabilization system are typically separately added to the aqueous built laundry detergent composition during the manufacture of the detergent composition, it is also possible to separately formulate a stabilized dry or aqueous enzyme preparation which can be added as such during detergent manufacture or can be added directly by the end user to the washing machine or to soiled fabrics. Similarly, the three-component stabilization system can be separately prepared in either dry form, e.g. powder or granules or as an aqueous solution and added directly during the manufacture of the laundry detergent composition prior to the addition thereto of the enzyme(s). Accordingly, the present invention also provides a stabilized enzyme preparation useful as a laundry additive containing either or both of protease and amylase enzyme, and an enzyme stabilizing effective amount of an enzyme stabilization system consisting essentially of (i) from about 0.25 to about 10 parts by weight of boric acid, boron oxide or alkali metal borate; (ii) from about 1 to about 3 parts by weight of an hydroxypolycarboxylic acid having 2 or 3 carboxylic acid groups and 1 to 4 hydroxyl groups and containing from 4 to 8 carbon atoms and (iii) a water-soluble calcium salt in an amount to provide from about 18 to about 50 millimoles calcium ion per liter. The present invention also provides an enzyme stabilization system with the three components (i), (ii) and (iii) as defined immediately above.

The present invention is predicated upon the discovery of a three component enzyme stabilizing system as herein defined which provides an enzyme stabilizing effect to aqueous liquid detergent compositions superior to that which can be achieved with conventional enzyme stabilizers. The enzyme stabilizing effect thus achieved reflects a synergy among the three components as most clearly manifested by the results in accelerated aging tests, including repetitive freeze-thaw cycles as described hereinafter.

DETAILED DESCRIPTION OF THE INVENTION

I. Enzyme Stabilization System

The enzyme stabilizing system of the invention is a mixture of (i) a boron compound selected from among boric acid, boric oxide and an alkali metal borate, particularly sodium borate, especially sodium tetraborate, e.g. borax ($Na_2BrO_7 \cdot 10H_2O$), (ii) an hydroxypolycarboxylic acid having from 4 to 8 carbon atoms, preferably 4, 5 or 6 carbon atoms, two or three carboxyl (—COOH) groups and 1 to 4, preferably 2 or 3 hydroxyl (—OH) groups, and (iii) a water-soluble calcium salt capable of providing calcium ($Ca^{++}$) ions in aqueous media.

The boron compound (i) is boric acid or a compound capable of producing boric acid, such as boric oxide or a salt, such as sodium borate. Borax is readily available and is preferred.

The boric acid compound is used in an amount of from about 0.25% to about 10%, preferably from about 0.5% to about 8%, more preferably from about 1% to about 5%, such as 2%, 3% or 4%, by weight, of the total detergent composition.

Citric acid is the preferred hydroxypolycarboxylic acid, especially in view of its ready availability and its contribution to improving the overall physical stability of the composition, i.e., prevent phase separation. However, other hydroxycarboxylic acids, such as malic acid, tartaric acid, isocitric acid, tricarballylic acid, trihydroxyglutaric acid and mucic acid, may also be used. Lactic acid, which has only 3 carbon atoms, will also provide enzyme stabilization; however, replacing e.g. citric acid with an equal weight of lactic results in compositions which are physically unstable—i.e. undergo phase separation.

The acid is usually incorporated into the composition as the free acid (or hydrated free acid), but may also be added in the form of its salt, especially alkali metal salt. In fact, it is thought that under the preferred alkaline pH conditions for the detergent compositions, the hydroxypolycarboxylic acid will be present in its ionized (salt) state.

The hydroxypolycarboxylic acid is used in an amount of from about 1% to about 3%, preferably from about 1.2 to 2.6%, by weight of the total detergent composition.

The level of calcium ion as component (iii) in the detergent composition is from about 18 to about 50 millimoles, preferably from about 22 to about 36 millimoles, per liter of the composition. Suitable water-soluble calcium salts which can be used as a source of calcium ion include both inorganic and organic salts, such as calcium chloride, calcium acetate and calcium formate. Calcium chloride is preferred. About 0.2% $CaCl_2$ corresponds to about 18 millimoles $Ca^{++}$ per liter. A small amount of calcium ion, generally from about 0.05 to about 0.4 millimole per liter, is often also present due to calcium in the enzyme preparation or water, but any such naturally present calcium ion will generally be insignificant to the added calcium ion.

As will be shown in the examples to follow, the individual ingredients (i), (ii) and (iii) are usually separately added in any convenient order during the manufacture of the aqueous built laundry detergent compositions. However, it may also be convenient in some cases to separately prepare a stabilized enzyme preparation which can then be directly added to the other ingredients of the laundry detergent composition. When used for this purpose, the stabilized enzyme composition may be formulated as a free flowing dry mix, such as powder or granules, containing up to about 20% by weight of water, or may be formulated as a concentrated aqueous solution. Furthermore, the aqueous stabilized enzyme preparation with or without any additional surface active agent, as required for stabilizing the composition, can also be used directly to assist in the laundering process, for example, as a separate additive for use in combination with an enzyme-free laundry detergent composition. The enzyme preparation may be added directly to the washing machine, before, after, or simultaneously with a separately prepared laundry detergent composition, or it may be used as a presoak by using it directly on soiled laundry. The three components (i), (ii) and (iii) in this embodiment of the invention will generally comprise from about 5 to 75% of the total composition, preferably 10 to 60% of the total composition, the balance being the enzyme and aqueous carrier, usually water which may contain a small amount of surface active agent, such as the anionic, nonionic or amphoteric surface active agents to be described below, for example, up to about 20%, preferably up to about 10% of the stabilized aqueous enzyme composition.

The three component stabilizing system may also be separately prepared without the enzyme and added as such to the remaining ingredients of the aqueous built laundry detergent composition at any time prior to the addition of the enzyme(s).

II. Enzyme

The alkaline proteolytic enzymes suitable for the present compositions include the various commercial liquid enzyme preparations which have been adapted for use in detergent compositions. Enzyme preparations in powdered form are also useful although, as a general rule, less convenient for incorporation into the built liquid detergent compositions. Thus, suitable liquid enzyme preparations include "Alcalase," "Savinase,", and "Esperase", all trademarked products sold by Novo Industries, Copenhagen, Denmark, and "Maxatase," "Maxacal," and "AZ-Protease" sold by Gist-Brocades, Delft, The Netherlands.

Among the suitable alpha-amylase liquid enzyme preparations are those sold by Novo Industries and Gist-Brocades under the tradenames "Termamyl" and "Maxamyl," respectively.

"Esperase" is particularly preferred for the present compositions because of its optimized activity at the higher pH values corresponding to the built detergent compositions.

Mixtures of proteolytic and amylase enzymes can and often are used to assist in removal of different types of stains.

The proteolytic enzyme and/or amylase enzyme will normally be present in the compositions in an effective amount in the range of from about 0.01% to about 5%, preferably from about 0.05% to about 2%, by weight of the composition. For the proteolytic enzymes, the suitable amounts will generally provide from about 0.005 to about 0.1, more preferably from about 0.01 to about 0.07 Anson units per gram of composition, depending on the use to which the composition will be applied. Generally, lower levels of amylase are required.

Lipolytic, cellulytic and carbohydroxylytic enzymes, all of which are also commercially available may also be employed.

III. Surface Active Detergent Compounds

The preferred detergents for use in the present liquid compositions are the synthetic anionic detergent compounds, and particularly alkyl polyethoxy sulfate. Other water soluble anionic detergent compound, such as higher alkylbenzene sulfonates may also be present in the instant formulas, such as potassium salts and in some instances the ammonium or alkanolamine salts, however, it has been found that the sodium salt is highly preferred, which is also the case with respect to the alkyl polyethoxy sulfate detergent component. The alkylbenzene sulfonate is one wherein the higher alkyl is of 12 to 15 carbon atoms, preferably 13 carbon atoms. The alkyl polyethoxy sulfate, which also may be referred to as a sulfated polyethoxylated higher linear alcohol or the sulfated condensation product of a higher fatty alcohol and ethylene oxide or polyethoxylene glycol, is one wherein the alkyl is of 10 to 18 carbon atoms, preferably 12 to 15 carbon atoms, e.g. about 13 carbon atoms, and which includes 3 to 11 ethylene oxide groups, preferably 3 to 7, more preferably 3 to 5 and most preferably 3, or about 3 ethylene oxide groups on average. Mixtures of the alkyl polyethoxy sulfate and alkylbenzene sulfonate are often advantageous and can be used at a ratio of alkylbenzene sulfonate to polyethoxy sulfate in the detergent mixture of from about 1:6 to 6:1 and most preferably from about 1:4 to 4:1, by weight. At ratios above 5:1, the physical stability of the product may be adversely affected.

In suitable circumstances other anionic detergents, such as fatty alcohol sulfates, paraffin sulfonates, olefin sulfonates, monoglyceride sulfates, sarcosinates and similarly functioning detergents, preferably as the alkali metal, e.g. sodium salts, can be present, sometimes in partial replacement of the previously mentioned synthetic organic detergents but usually, if present, in addition to such detergents. Normally, the supplementing detergents will be sulfated or sulfonated products (usually as the sodium salts) and will contain long chain (e.g. 8 to 20 carbon atoms) linear or fatty alkyl groups.

In addition to any supplementing anionic synthetic organic detergents, there also may be present nonionic and amphoteric materials, like the Neodols® sold by Shell Chemical Company, which are condensation products of ethylene oxide and higher fatty alcohols, e.g. Neodol® 23-6.5, which is a condensation product of a higher fatty alcohol of about 12 to 13 carbon atoms with about 6.5 moles of ethylene oxide. Illustrations of the various detergents and classes of detergents mentioned may be found in the text *Surface Active Agents*, Vol. II, by Schwartz, Perry and Berch (Interscience Publishers, 1958), the descriptions of which are incorporated herein by reference.

The nonionic detergents also include the polyethylene oxide condensate of 1 mole of alkyl phenol containing in the alkyl group from about 6 to 12 carbon atoms in a straight or branched chain configuration with about 5 to 30 moles of ethylene oxide, for example, nonyl phenol condensed with 9 moles of ethylene oxide; dodecyl phenol condensed with 15 moles of ethylene oxide; and dinonyl phenol condensed with 15 moles of ethylene oxide. Condensation products of the corresponding alkyl thiophenols with 5 to 30 moles of ethylene oxide are also suitable.

Of the nonionic surfactants, those of the ethoxylated and mixed ethoxylated propyloxylated fatty alcohol type are preferred. Examples of preferred nonionic surfactants include the condensation product of coconut fatty alcohol with about 6 moles of ethylene oxide per mole of coconut fatty alcohol; the condensation product of tallow fatty alcohol with about 11 moles of ethylene oxide per mole of tallow fatty alcohol; the condensation product of a secondary fatty alcohol containing about 11-15 carbon atoms with about 9 moles of ethylene oxide per mole of fatty alcohol and condensation products of more or less branched primary alcohols, whose branching is predominantly 2methyl, with from about 4 to 12 moles of ethylene oxide.

Especially preferred nonionics are represented by the commercially well-known class of nonionics which are the reaction product of a higher linear alcohol and a mixture of ethylene and propylene oxides, containing a mixed chain of ethylene oxide and propylene oxide, terminated by a hydroxyl group. Examples include the nonionics such as a $C_{13}$–$C_{15}$ fatty alcohol condensed with 7 moles propylene oxide and 4 moles ethylene oxide, a $C_{13}$–$C_{15}$ fatty alcohol condensed with 5 moles propylene oxide and 10 moles ethylene oxide, a $C_{13}$–$C_{15}$ fatty alcohol condensed with 6 moles ethylene oxide and 3 moles propylene oxide, etc.

Generally, the mixed ethylene oxide-propylene oxide fatty alcohol condensation products represented by the general formula $$RO(C_3H_6O)_p(C_2H_4O)_qH,$$

wherein R is a hydrocarbyl group, such as straight or branched, primary or secondary aliphatic hydrocarbon, preferably alkyl or alkenyl, especially preferably alkyl, of from 8 to 20, preferably 10 to 18, especially preferably 12 to 18 carbon atoms, p is a number of from 2 to 8 on average, preferably 3 to 6, and q is a number of from 2 to 12 on average, preferably 4 to 10, can be advantageously used where low foaming characteristics are desired. In addition, these surfactants have the advantage of low gelling temperatures. Mixtures of two or more of the mixed ethylene oxide-propylene oxide fatty alcohol condensation product can be used as can mixtures of the mixed ethylene oxide-propylene oxide condensation products with any of the above alkoxylated nonionics, or mixtures of the ethoxylated nonionics can also be used.

Ampholytic detergents are also suitable for the invention. Ampholytic detergents are well known in the art and many operable detergents of this class are disclosed by A. M. Schwartz, J. W. Perry and J. Berch in "Surface Active Agents and Detergents," Interscience Publishers, N.Y., 1958, Vol. 2. Examples of suitable amphoteric detergents include: alkyl betaiminodipropionates, $RN(C_2H_4COOM)_2$; alkyl beta-aminopropionates, $RN(H)C_2H_4COOM$; and long chain imidazole derivatives having the general formula:

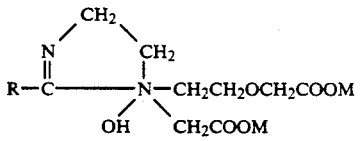

wherein in each of the above formulae, R is a hydrophobic hydrocarbyl group, preferably an aliphatic group, containing from about 8 to 20 carbon atoms, especially 10 to 18 carbon atoms, and M is a cation, e.g. alkali metal, ammonium salt, amine, alkanol amine, etc., to neutralize the charge of the anion. Specific operable amphoteric detergents include, for example, the disodium salt of undecylcycloimidiniumethoxyethionic acid-2-ethionic acid, dodecyl beta alanine, and the inner salt of 2-trimethylamino lauric acid.

An especially preferred class of amphoteric surfactants are the glycinate derivatives of the formula:

$$R-(\underset{\underset{T}{|}}{N}-[CHR^1]_x)_y-\underset{\underset{T}{|}}{N}-W$$

wherein R is a hydrocarbyl group, preferably aliphatic, of 8 to 20 carbon atoms, $R^1$ is hydrogen or alkyl of 1 to 6 carbon atoms, preferably hydrogen, $R^2$ is alkylene of 1 to 6 carbon atoms, preferably methylene, T is hydrogen or W, preferably W, W is $R^2COOM$, M is hydrogen, alkali metal, alkaline earth metal, ammonium or substituted ammonium, such as lower alkanolammonium, e.g., triethanol-ammonium, x is 2 to 3 and y is 2 to 4. A preferred amphoteric surfactant is of the formula $$R-(\underset{\underset{CH_2COOM}{|}}{N}-CH_2CH_2CH_2)_y-\underset{\underset{CH_2COOM}{|}}{N}-CH_2COOM,$$

wherein R is an aliphatic hydrocarbyl, preferably fatty alkyl or fatty alkylene, of 16 6o 18 carbon atoms, M is alkali metal, and y is 3 to 4. More preferably R is tallow-alkyl (which is a mixture of stearyl, palmityl and oleyl in the proportions in which they occur in tallow), M is sodium and y is about 3.5, representing a mixture of about equal parts of the amphoteric surfactant wherein y is 3 and such amphoteric surfactant wherein y is 4. Among the more preferred amphoteric surfactants of this type is that available commercially under the trade name AmpholakTM TM 7TX, which is obtainable from Kenobel AB, a unit of Nobel Industries, Sweden.

The amount of the detergent active compound(s) will generally range from about 5% to about 75%, more usually from about 5% to about 30%, especially from about 8% to about 15%, by weight of the composition. The preferred anionic surfactant is usually present in amounts of from about 1 to 25%, preferably from about 4 to 20%, especially preferably from about 5 to 15% by weight of the composition.

The nonionic surfactant, when present, is usually contained in amounts of from about 1 to 10%, preferably from about 2 to 8%, by weight and the amphoteric, when present, may comprise from about 0.3 to 15%, preferably 1 to 10%, especially preferably from about 2 to 8% by weight, based on the total composition.

IV. Detergent Builder

Any of the conventional inorganic or organic water-soluble or water dispersible detergency builders can be used in the compositions of this invention.

Among the inorganic builders, the alkali metal polyphosphates and alkali metal carbonates or bicarbonates are preferred. Sodium tripolyphosphate is especially preferred but other phosphate builders, such as tetrasodium pyrophosphate, tetrapotassium pyrophosphate, sodium metaphosphate, and the like, can also be used. Mixtures of sodium tripolyphosphate and sodium carbonate, as disclosed in U.S. Pat. No. 4,842,769, incorporated herein by reference, may also be useful.

Suitable builders of the organic type include, for example, polycarboxylate builders, such as aminopolycarboxylates, for example, sodium and potassium ethylene-diamine tetraacetate; sodium and potassium nitrotriacetate; and the polyacetal polycarboxylates, such as those described, for example, in U.S. Pat. Nos. 4,144,226 and 4,315,092. Other organic builders of the polycarboxylate type include the water-soluble salts, especially sodium and potassium salts, of mellitic acid, citric acid, pyromellitic acid, benzene polycarboxylic acids, carboxymethyloxy succinic acid, cis-cyclohexane hexacarboxylic acid, and the like. Citric acid salts, e.g. sodium citrate, is often a preferred builder in non-phosphate or low phosphate formulations, and may also be used in this capacity in the detergent-enzyme compositions of this invention, in addition to any citrate which may be used in the enzyme stabilizing system of this invention.

Polyphosphonate salts represent another useful class of detergency builders, for example, sodium and potassium salts of ethylene diphosphonic acid, ethane-1-hydroxy-1,1-diphosphonic acid, and ethane-1,1,2-triphosphonic acid.

Aminopolyphosphonate compounds are also useful builders and may also be advantageously used as sequestrants. Suitable examples include soluble salts, e.g. sodium or potassium salts, of diethylene triamine pentamethylene phosphonic acid, ethylene diamine tetramethylene phosphonic acid, and hexamethylenediamine tetramethylene phosphonic acid.

The present compositions may also incorporate a water soluble acrylic polymer which function as viscosity stabilizers, and in some cases can act to enhance cleaning performance under actual use conditions and may also be useful as deflocculents. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolized acrylonitrilemethacrylonitrile copolymers, or mixtures thereof. Water soluble salts or partial salts of these polymers such as the respective alkali metal (e.g. sodium, potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 5,000 or 6,000. These polymers are commercially available, and methods for their preparation are well-known in the art.

For example, commercially-available polyacrylate solutions useful in the present cleaning compositions include the sodium polyacrylate solution, Colloid ®207 (Colloids, Inc., Newark, N.J.); the polyacrylic acid solution, Aquatreat ®AR-602-A (Alco Chemical Corp., Chattanooga, Tenn.); the polyacrylic acid solutions (50–65% solids) and the sodium polyacrylate powders (M.W. 2,100 and 6,000) and solutions (45% solids) available as the Goodrite ®K-700 series from B. F. Goodrich Co.; and the sodium- or partial sodium salts of polyacrylic acid solutions (M.W. 1000 to 4500) available as the Acrysol ® series from Rohm and Haas.

Other natural or synthetic thickening agents or viscosity modifiers may also be added to the application. Such conventional thickening agents include, for example, methyl cellulose, carboxymethylcellulose (CMC), starch, polyvinyl pyrrolidone (PVP), gelatin, colloidal silica, natural or synthetic clays and the like.

The detergent builder may also include water insolubletype, especially the aluminosilicate type, particularly the zeolites, such as Zeolite A, usually in the form of its crystalline hydrate, although amorphous zeolites may also be useful.

The amount of detergent builder may range from about 5% to about 30%, especially from about 5% to about 25%, more preferably from about 10 to 20%, by weight, based on the total composition.

When the polyacrylate is used it is usually present in only minor amounts, such as from about 0.05 to 3%, preferably from about 0.1 to 1%, by weight of the composition.

V. Other Optional Components

Other conventional materials may also be present in the liquid detergent compositions of the invention, for example, soil-suspending agents, hydrotropes, corrosion inhibitors, dyes, perfumes, silicates, optical brighteners, suds boosters, suds depressants, e.g. silicone antifoaming agents, germicides, e.g. quaternary ammonium salts, preservatives, e.g. quaternium 15, anti-tarnishing agents, opacifiers, fabric-softening agents, oxygen-liberating bleaches such as sodium perborate or percarbonate with or without bleach precursors, buffers and the like.

A preferred fabric-softening agent is a smectite clay, such as sodium and calcium montmorillonites, sodium saponites, and sodium hectorites. The sodium and calcium bentonites which are colloidal clay containing montmorillonites, such as the swelling bentonites wherein the predominant cation is sodium or calcium, are preferred. The Western or Wyoming bentonites are especially preferred. Furthermore, the calcium clays often provide superior softening performance than the sodium clays.

The swelling capacity of bentonite is generally associated with its fabric softening properties. In water the swelling capacity of sodium bentonite is in the range of 3 to 20 milliliters/gram, preferably 7 to 15 ml/gram, and its viscosity, at 6% concentration in water, is usually in the range of 3 to 30 centipoises, preferably 8 to 30 centipoises.

Preferred swelling bentonites are sold under the trademark HI-JEL by Georgia Kaolin Co. These materials are the same as bentonites which were formerly sold under the trademarks MINERAL COLLOID and THIXO-JEL. They are selectively mined and beneficiated bentonites, and those considered to be most useful are available as HI-JEL Nos. 1, 2, 3, etc., corresponding to THIXO-JEL's Nos. 1, 2, 3, and 4. Such materials have a maximum free moisture content (before addition to the liquid medium) of 4% to 8% and specific gravities of about 26. The bentonite is preferably one which will pass through a 200 mesh U.S. Sieve Series sieve, and most preferably at least 90% of the particles will pass through a No. 325 sieve, so that the equivalent diameter of the bentonite may be considered to be less than 74 microns, and more preferably less than about 44 microns.

Typical chemical analyses of some bentonites that are useful for making the present liquid detergents show that they contain from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Although the Western bentonites are preferred, it is also possible to utilize other bentonites, such as those which may be made by treating Italian or similar bentonites containing relatively small proportions of exchangeable monovalent metals (sodium and potassium) with alkaline materials, such as sodium carbonate or calcium chloride, to increase the cation exchange capacities of such products. It is considered that the $Na_2O$ content of the bentonite should be at least about 0.5%, preferably at least 1% and more preferably at least 2% so that the clay will be satisfactorily swelling, with good softening and dispersing properties in aqueous suspension. Preferred swelling bentonites of the types described above are sold under the trade names Laviosa and Winkelmann, e.g. Laviosa AGB and Winkelmann G13.

Other bentonites which are particularly useful in the present liquid detergent compositions because of their white or very light color include American Colloid Company's Polarite KB 325, a California bentonite, and Georgia Kaolin's GK 129, a Mexican bentonite.

When present, the amount of the clay softening agent will usually be within the range of from about 5 to about 20% by weight, preferably from about 6 to 15% by weight, based on the total composition Another optional, but often preferred additive, in minor amounts, is a higher fatty acid, which may be saturated or unsaturated, and may contain from about 10 to about 22 carbon atoms, preferably from about 16 to 20 carbon atoms. Oleic acid is especially preferred in amounts of from about 0.1 to about 5%, preferably from about 0.5 to 2.5%, by weight of the composition.

These higher fatty acids function in the invention compositions as anti-foaming agents. They may be used alone for this function but are often used in combination with the polysiloxane (silicone) anti-foaming agents. The silicone antifoaming agents will generally be present in minor amounts compared to the fatty acid. Suitable ratios (by weight) of the fatty acid anti-foaming agent to silicone anti-foaming agent may range from about 100:1 to 1:10, preferably 50:1 to 1:1, especially 30:1 to 2:1.

VI. Liquid Carrier

The liquid carrier for the liquid compositions of this invention is preferably water alone but an aqueous carrier containing minor amounts of a lower alcohol, such as ethanol or isopropanol, may also be used in some cases.

Generally, water levels may be up to about 70% by weight of the composition, for example, from about 20 to about 70%, preferably from about 30% to 60%, by weight. The water may be deionized, but usually tap water is sufficient.

The viscosity of the present liquid detergent is normally in the range of about 1000 to 10,000 centipoises, preferably 2000–7000 centipoises, but products of other suitable viscosities may also be useful. At the viscosities mentioned, the liquid detergent is pourable, stable, nonseparating and uniform. The pH of the liquid detergent suspension usually in the range of 7 to 11.5, preferably 8 to 10.5, appears to help to maintain product stability and pourability.

As necessary, pH modifiers, such as water soluble bases, e.g. caustic, amines, or ammonia, or acids, preferably mineral acids, e.g. HCl, will be added to obtain the desired pH level.

VII. Processing

Although the ingredients can often be added in any desired order usually the enzyme will be the last added ingredient and will always follow the addition of the enzyme stabilizing additives.

Conventional manufacturing methods may be employed to a large extent in the prosecution of the described liquid detergent compositions. In one procedure, a portion of the aqueous medium may be added to a mixing vessel and the surfactant components may be mixed therewith in any suitable order, such as anionic, nonionic and amphoteric detergents, followed by higher fatty acid and hydroxypolycarboxylic acid and neutralizing agent, such as sodium hydroxide solution. Then sodium tripolyphosphate and/or other builders may be added, followed by polyacrylate, enzyme and boric acid and calcium ion source. Bentonite may be pre-mixed with another portion of the water or may be added directly to the composition, sometimes with additional water, after which the balance of the water, brightener, dye and perfume may be admixed. When other components of the detergent composition are also employed, they may be added to the mixer at appropriate times and the various orders of addition may be modified to make them appropriate to the types of products being made and to the types of equipment being used.

In an alternative procedure which has been found convenient, there is first formed a premixture (premix) of the calcium compound with some or all of the surface active compounds and with some or all of the hydroxypolycarboxylic acid. The premix is prepared as a homogeneous aqueous mixture wherein the aqueous media (e.g. water) may be added as such or as a carrier for one of the other ingredients in the premix. Anti-foaming agent may be included in the premix or in the main batch or both. Thickening or viscosity modifiers and clay softener are preferably added to the main mixing batch, the viscosity modifiers generally being added at or near the beginning of the mixing sequence and clay added near the end of the mixing sequence before or after the premix.

A convenient order for addition of the ingredients is water, thickener, coloring agents and/or brighteners, borax and builder followed by the clay and premix and anti-foaming agent. Final pH adjustment is usually made right before the enzyme component(s). The precise order of addition will depend on the specific ingredients, type of mixing apparatus and desired characteristics in the final product.

The following examples illustrate, but do not limit the invention. Unless otherwise indicated, all parts and percentages are by weight and temperatures are in ° F.

EXAMPLE 1

A liquid enzyme containing composition is prepared by first thoroughly mixing the following ingredients in the recited order until each ingredient is completely dissolved or uniformly dispersed to form a premix.

| Ingredient | Amount Added (wt %) | Amount Added Active Ingred. (as 100% a.i) (wt %) |
|---|---|---|
| $CaCl_2$ | 0.40 | 0.40 |
| AEOS[1] (28%) | 8.57 | 2.40 |
| LAS[2] (50%) | 18.14 | 9.07 |
| NaOH (50%) | 1.20 | 0.60 |
| Carboxymethyl cellulose | 0.18 | 0.18 |
| Tinopal LMS-X (optical brightener) | 0.30 | 0.30 |
| Citric acid, Hydrate | 2.00 | 2.00 |
| Borax | 3.00 | 3.00 |
| Sodium tripolyphosphate (STPP | 15.00 | 15.00 |
| LAS (50%) | 14.00 | 7.00 |
| Silicone antifoam (20%) | 3.00 | 0.60 |
| Calcium Bentonite Clay | 11.00 | 11.00 |
| Jumelle perfume | 1.00 | 1.00 |
| Quaternium 15[3] | 0.10 | 0.10 |
| Tap Water | 33.59 | 33.59 |
| HCl | to adjust pH to 7.2 | |
| Alcalase Enzyme 2.5 L-DX | 0.6 | 0.60 |
| TOTAL | 100 | |

[1]Sodium alkyl polyethoxy sulfate wherein the alkyl is 12 to 15 carbon atoms and the polyethoxy is 3 ethoxy groups.
[2]Sodium dodecyl benzene sulfonate
[3]Dowicil 200 by Dow Chemical [cis-isomer of 1-(3-chloroalkyl)-3,5,7-triaza-1-azoniaadamantine chloride]

In the above composition, the enzyme stabilization system of borax/citric acid/calcium chloride is present at a mixing ratio of 3/2/0.4.

The enzyme stability is measured after being stored for four weeks at each of the following temperatures: 4°

C., room temperature (20° C.), 35° C. and 43° C. The results are shown in Table 1. Also shown in Table 1 is the enzyme stability of the same composition except that the enzyme stabilization system ($CaCl_2$, borax and citric acid) is omitted.

TABLE 1

ENZYME STABILITY AFTER 4 WEEKS AGING

| Product | Stabilization System | Remaining Activity (%) 4° C. | RT | 35° C. | 43° C. |
|---|---|---|---|---|---|
| EX 1 | Yes | 75 | 37 | 13 | 0 |
| Control | No | 48 | 7 | 0 | 0 |

at 1° C./min. to 122° F. (50° C.), and maintained at this elevated temperature for 2 hours. After 8, 24, 40, 72 and 80 cycles, the remaining enzyme activity is measured. The results are shown in Table 1. For comparison, the same test is run on compositions identical to that of example 1 but in which the amounts of borax, $CaCl_2$ or citric acid are varied as also shown in Table 1 along with the results of the accelerated aging tests on these comparative compositions. As a further comparison, citric acid in the above example is replaced by an equal weight of Sokolan ®DCS, a mixture of succinic acid, glutaric acid and adipic acid (1:1.6:1). The results are also shown in Table 2.

TABLE 2

ENZYME STABILITY
FREEZE AND THAW (28° F. TO 122° F.) TEST

| Example (EX) or Comparative Example (CEx) | Enzyme Stabilization System Borax (weight % in composition) | Citric Acid | $CaCl_2$ | Remaining Activity (%) 8th Cycle | 16th Cycle | 24th Cycle | 40th Cycle | 72nd Cycle | 80th Cycle |
|---|---|---|---|---|---|---|---|---|---|
| EX 2 | 3 | 2 | 0.3 | 57 | 48 | 45 | 39 | 31 | 25 |
| CEx 1 | 3 | — | 0.3 | 32 | 20 | 10 | 5 | — | — |
| CEx 2 | 5 | — | 0.3 | 45 | 31 | 24 | 14 | — | — |
| CEx 3 | — | 2 | 0.3 | 5 | 8 | 4 | — | — | — |
| CEx 4 | — | 2 | — | 6 | 4 | 0 | — | — | — |
| Control | 3 | 2* | 0.3 | 44 | 23 | 21 | 11 | 5 | |

*Sokolan DCS, from BASF, a mixture of succinic acid/glutaric acid/adipic acid (30/40/30)

EXAMPLE 2

The composition shown below is prepared similarly to the composition of Example 1.

| Ingredient | Amount Added (wt %) | Nominal Concentration (as 100% a.i.) (wt %) |
|---|---|---|
| Citric Acid, hydrate | 2.0 | 2.0 |
| $CaCl_2$ | 0.3 | 0.3 |
| Borax | 3.0 | 3.0 |
| Nonionic(2) | 2.50 | 2.5 |
| Tallow Amphopolycarboxy-glycinate(4) (30%) | 6.00 | 1.8 |
| AEOS(1) (28%) | 31.07 | 8.7 |
| Sodium Polyacrylate (MW = 2000) (40%) | 1.00 | 0.4 |
| STPP | 15.00 | 15.0 |
| Calcium Bentonite Clay | 11.00 | 11.0 |
| Oleic Acid | 1.50 | 1.5 |
| Silicone Antifoam (20%) | 3.00 | 0.6 |
| Acid Blue color | 0.002 | 0.002 |
| Food Blue 5 Color | 0.001 | 0.001 |
| Tinopal LMX | 0.30 | 0.3 |
| NaOH (50%) | 2.00 | 1.0 |
| Quaternium 15(3) | 0.10 | 0.1 |
| Jumelle perfume | 1.00 | 1.0 |
| Alcalase 2.5 LDX | 0.60 | 0.6 |
| Water | | q.s. to 100% |
| HCl | | to pH = 7.3 |

(1)Same as in Example 1 - see footnote (1)
(2)$C_{13}$-$C_{15}$ fatty alcohol condensed with 7 moles ethylene oxide and 4 moles propylene oxide
(3)Same as in Example 1 - see footnote (3)
(4)Ampholak TM 7TK, from Kenobe AB The composition is subjected to an accelerated aging test ("freeze and thaw") to predict the stability of enzyme activity under long term storage conditions.

The accelerated aging test is carried out in an automatic computer controlled double boiler. During each test cycle, the temperature is first decreased at 1° C./min. to 28° F. (−2° C.) and maintained at this temperature for 2 hours, then the temperature is increased The composition of Example 2 and the Sokolan R DCS control are also compared for long term storage (aging) characteristics by measuring the remaining enzyme activity (as a percent of the original activity) at 4° C., room temperature, 35° c. and 43° C. The enzyme stability in terms of remaining activity (percent of original activity) is measured at the end of 2 weeks, 4 weeks and 8 weeks at each temperature. The results are shown in Table 3.

TABLE 3

Enzyme Stability Long Term Aging

| Time (Weeks) | Aging Temperature 4° C. (EX 2) | R.T. EX 2 | R.T. Control | 35° C. EX 2 | 35° C. Control | 43° C. EX 2 | 43° C. Control |
|---|---|---|---|---|---|---|---|
| 2 | | 79 | 72 | 58 | 42 | 42 | 30 |
| 4 | 98 | 78 | 71 | 52 | 44 | 43 | 29 |
| 8 | | 64 | 55 | 47 | 25 | 34 | 24 |

Example 3

| Component | Percent |
|---|---|
| Pentasodium tripolyphosphate | 11.0 |
| Bentonite (Georgia-Kaolin 129) | 12.0 |
| Sodium carbonate | 2.0 |
| Sodium sesquicarbonate | 2.0 |
| Sodium linear tridecylbenzene sulfonate (LTBS) | 8.0 |
| AEOS(1) | 3.0 |
| Carboxymethyl cellulose (CMC) | 0.2 |
| Optical brightener (Tinopal LMX-X) | 0.3 |
| Perfume | 0.4 |
| Enzyme (Esperase 8.0L)(2) | 1.0 |
| $CaCl_2$ | 0.6 |
| Borax | 2.5 |
| Citric Acid | 2.0 |
| Water and adjuvants | Balance |

(1)Sodium alkyl polyethoxy sulfate wherein alkyl is 12 to 15 carbon atoms and the polyethoxy is 3 ethoxy groups.
(2)"Esperase" sold by Novo Industries having an activity of 8.0 KNPU/gram.

The composition shown above is prepared by the following procedure: 30.0 parts of deionized water at 40° F. are added to a suitable mixing apparatus such as a vertical cylindrical tank equipped with a stirrer. With the stirrer adjusted for medium agitation, a mixture consisting of 2.0 parts anhydrous soda ash, 2.0 parts sodium sesquicarbonate, and 0.2 parts sodium carboxymethyl cellulose is incorporated into the water. The stirrer speed is then increased to maximum agitation and a mixture comprised of 11.0 parts pentasodium tripolyphosphate and 12.0 parts bentonite is slowly added to the mixing apparatus over a period of 10–15 minutes to form an offwhite suspension. The agitation speed is then decreased to a slow/medium setting while 8.64 parts of high AI (about 55%) LTBS slurry is added. Thereafter the optical brightener/color solution is added consisting of 0.3 parts Tinopal LMS-X (CIBAGEIGY), 0.909 parts colorant, and 4.02 parts deionized water. Once a uniform blueish-green colored solution is obtained, 0.4 parts of perfume is added to the mixture under agitation. This is followed by the slow addition of 0.6 parts $CaC_{12}$ and 2.5 parts borax as a two component slurry. Stirring is continued until the mixture is uniform in appearance and then 2.0 parts of citric acid and 9.0 parts water are slowly added. Agitation of the mixture is then reduced while 10.95 parts of a mixed AI detergent base consisting of an LTBS slurry (about 30% AI) and AEOS (About 27.5% AI) is added to the mixture. This is followed by the slow addition of 1.0 parts proteolytic enzyme with continuous agitation until all materials are completely dispersed or dissolved.

Enzyme stabilization similar to that of Example 1 will be obtained.

What is claimed is:

1. An enzyme-containing liquid detergent composition comprising
   (A) from about 5 to about 75% by weight, of one or more surface active detergent compounds;
   (B) from about 5 to about 30%, by weight, of one or more water-soluble detergency builders selected from the group consisting of alkali metal polyphosphates, alkali metal carbonates, alkali metal nitrilotriacetates, polyacetal carboxylates, and mixtures thereof;
   (C) from about 0.01 to about 5%, by weight, of proteases enzymes;
   (D) an enzyme stabilization system comprising
      (i) from about 0.25 to about 10%, by weight, of a boron compound selected from the group consisting of boric acid, boric oxide, and alkali metal borates;
      (ii) from about 1 to about 3%, by weight, of an hydroxypolycarboxylic acid selected from the group consisting of aliphatic di- and tri-carboxylic acids with from 1 to 4 hydroxyl groups and with from 4 to 8 carbon atoms; and
      (iii) a water soluble calcium salt in an amount sufficient to provide from about 18 to about 50 millimoles of calcium ion per liter of the composition; and
   (E) water.

2. The liquid detergent composition of claim 1 wherein the detergency builder comprises an alkali metal polyphosphate.

3. The liquid detergent composition of claim 2 wherein the alkali metal polyphosphate is sodium tripolyphosphate.

4. The liquid detergent composition of claim 1 wherein the enzyme stabilization system comprises (i) borax, (ii) citric acid and (iii) calcium chloride.

5. The liquid detergent composition of claim 4 wherein the enzyme stabilization system comprises from about 0.5 to about 8% by weight (i), from about 1.5 to about 2.5% by weight (ii) and (iii) in an amount sufficient to provide from about 22 to about 36 millimoles of calcium ion per liter of the composition.

6. The liquid detergent composition of claim 1 wherein the enzyme stabilization system comprises from about 0.5 to about 8% by weight (i), from about 1.5 to about 2.5% by weight (ii) and (iii) in an amount sufficient to provide from about 22 to about 36 millimoles of calcium ion per liter of the composition.

7. The liquid detergent composition of claim 1 which further comprises a softening effective amount of a clay softening agent.

8. The liquid detergent composition of claim 1 which comprises (A) from about 5 to about 30%, by weight, of a mixture of (a) non-soap anionic surface active compound and (b) nonionic surface active detergent compound at an (a):(b) ratio, by weight, of from about 1:4 to about 10:1.

9. The liquid detergent composition of claim 8 wherein the anionic (a) is an alkyl polyethoxy sulfate wherein the alkyl is from 10 to 18 carbon atoms and which includes from 3 to 11 ethoxy groups, and wherein the nonionic (b) is a mixed ethylene oxide-propylene oxide fatty alcohol condensation product of the formula $$RO(C_3H_6O)_p(C_2H_4O)_qH$$

wherein R is a straight or branched, primary or secondary aliphatic hydrocarbon, of from 6 to 20 carbon atoms, p is a number of from 2 to 8 on average, and q is a number of from 2 to 12 on average.

10. The liquid detergent composition of claim 1 which further comprises one or more additional adjuvants selected from higher fatty acid of from about 10 to 22 carbon atoms, soil-suspending agents, hydrotropes, corrosion inhibitors, dyes, perfumes, silicates, optical brighteners, perfume, antifoaming agents, germicides, fabric softening agents, pH modifiers and pH buffers.

11. A built aqueous liquid enzyme containing cleaning composition comprising
   (A) from about 5 to about 30%, by weight, of at least one surface active detergent compound selected from the group consisting of anionic, nonionic and ampholytic detergent compounds;
   (B) from about 5 to about 25%, by weight, of at least one detergency builder salt selected from the group consisting of alkali metal polyphosphates, alkali metal carbonates, alkali metal nitrilotriacetates, polyacetal carboxylates, and mixtures thereof;
   (C) from about 0.1 to about 3%, by weight, protease enzyme;
   (D) an enzyme stabilization system containing
      (i) from about 0.5 to about 8%, by weight, of boric acid, boric oxide or alkali metal borate;
      (ii) from about 1.5 to about 2.5%, by weight, of citric acid; and
      (iii) a water-soluble calcium salt in an amount sufficient to provide from about 22 to about 36 millimoles of calcium ion per liter of the composition;
   (E) from about 5 to about 20% by weight of a clay softening agent; and
   (F) water, and optionally perfume and other adjuvants.

12. A method of laundering stained or soiled fabrics comprising contacting the fabrics with the stabilized enzyme containing liquid detergent composition of claim 1.

13. A stabilized enzyme preparation useful as a laundry additive which consists essentially of protease enzymes, and an enzyme stabilizing effective amount of an enzyme stabilization system consisting essentially of (i) from about 0.25 to about 10 parts by weight of a boron compound selected from the group consisting of boric acid, boron oxide, and alkali metal borates; (ii) from about 1 to about 3 parts by weight of an hydroxypolycarboxylic acid selected from the group consisting of aliphatic di- and tri-carboxylic acids with from 1 to 4 hydroxyl groups and with from 4 to 8 carbon atoms; and (iii) a water soluble calcium salt in an amount to provide from about 18 to about 50 millimoles of calcium ion per liter.

14. The stabilized enzyme preparation of claim 13 in the form of a powder.

15. The stabilized enzyme preparation of claim 13 in the form of an aqueous solution.

16. The stabilized enzyme preparation of claim 13 wherein the hydroxypolycarboxylic acid is citric acid.

17. The stabilized enzyme preparation of claim 16 wherein the enzyme stabilization system contains from about 0.5 to about 8 parts of (i), from about 1.5 to about 2.5 parts (ii) and (iii) in an amount sufficient to provide from about 22 to about 36 millimoles of calcium ion per liter.

18. The stabilized enzyme preparation of claim 17 wherein (i) is borax and (iii) is calcium chloride.

19. A composition for addition to a protease or amylase enzyme containing aqueous laundry detergent composition to stabilize the enzyme against degradation, said composition consisting essentially of (i) from about 0.25 to about 10 parts by weight of boric acid, boron oxide or alkali metal borate; (ii) from about 1 to about 3 parts by weight of citric acid, and (iii) a water soluble calcium salt in an amount to provide from about 18 to about 50 millimoles of calcium ion per liter when added to an aqueous laundry detergent composition containing up to about 5% by weight of said enzyme.

20. The composition of claim 19 in the form of a powder.

21. The composition of claim 19 in the form of an aqueous solution.

* * * * *